US007195337B2

(12) United States Patent
Kulpa et al.

(10) Patent No.: US 7,195,337 B2
(45) Date of Patent: Mar. 27, 2007

(54) POSTAGE METER PRINT HEAD AND CARRIAGE

(75) Inventors: Walter J. Kulpa, Trumbull, CT (US); Norman L. Barrigas, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 248 days.

(21) Appl. No.: 10/955,043

(22) Filed: Sep. 30, 2004

(65) Prior Publication Data

US 2005/0264606 A1 Dec. 1, 2005

Related U.S. Application Data

(60) Provisional application No. 60/481,859, filed on Jan. 5, 2004.

(51) Int. Cl.
*B41J 2/14* (2006.01)
*B41J 2/175* (2006.01)

(52) U.S. Cl. ..... 347/50; 347/49; 347/85

(58) Field of Classification Search ..... 347/50, 347/84, 85, 86, 37, 49, 87
See application file for complete search history.

(56) References Cited

U.S. PATENT DOCUMENTS 5,208,610 A * 5/1993 Su et al. ..... 347/49
6,234,694 B1 * 5/2001 Brookner ..... 400/76
6,846,067 B2 * 1/2005 Lim ..... 347/49

* cited by examiner

*Primary Examiner*—Stephen Meier
*Assistant Examiner*—Lisa M. Solomon
(74) *Attorney, Agent, or Firm*—George M. Macdonald; Angelo N. Chaclas

(57) ABSTRACT

A mailing machine print head and carriage that use one or more systems or elements to latch the print head in a controlled location and to guide it into and out of that location in a manner that prevents debris from being transferred to the electrical connector contacts is provided.

15 Claims, 4 Drawing Sheets

POSTAGE METER PRINT HEAD AND CARRIAGE

CROSS REFERENCE TO RELATED APPLICATIONS

This application claims priority under 35 U.S.C. section 119(e) from Provisional Patent Application Ser. No. 60/481,859, filed Jan. 5, 2004, entitled POSTAGE METER PRINT HEAD AND CARRIAGE, which is incorporated herein by reference in its entirety.

BACKGROUND

The illustrative embodiments described in the present application are useful in systems including those for providing funds accounting and evidencing and more particularly are useful in systems including those for providing for accounting of postage and evidence of postage by printing postage indicia on an envelope using an ink jet printer.

Mailing machines including postage meters often employ an ink-jet printing unit for printing evidence of postage payment in the form of postage indicia. Systems for printing information on a mailing medium are described in U.S. Pat. No. 6,550,994B2, issued Apr. 22, 2003 to Manduley.

The print head of an ink jet printing mechanism such as that in a mailing machine may become inoperable during the life of the printing mechanism. In such a situation, the print head would need to be replaced. If the print heads are removable, they are typically latched into a print head carriage. Many typical printing mechanism systems include latching mechanisms for latching a print head to a print carriage that use a large number of small parts. Using such a large number of small parts adds to the cost and complexity of the printing mechanism.

Additionally, such typical systems often do not adequately address that fact that the face of the print head and its surrounding edges may have accumulations of ink and paper dust on them. During the print head removal process, the debris can be transferred to the electrical connector contacts for the print head in the print carriage. Such debris could form an insulating barrier causing the new print head to malfunction. Furthermore, the typical latching mechanism is usually incorporated into the print carriage such that any malfunction or failure of the latching mechanism would require that a technician replace the entire print carriage.

Accordingly, the prior art does not provide a print head latching system that prevents or reduces debris accumulation. Furthermore, the prior art does not provide a print head latching system having a small number of parts that are incorporated into the print head.

SUMMARY

Accordingly, it is an object of the present application to describe illustrative print head latching systems that prevent or reduce debris accumulation. It is an additional object of the present application to describe illustrative print head latching systems having a small number of parts that are incorporated into the print head.

The illustrative embodiments of the present application describe a mailing machine print head and carriage that use one or more systems or elements to latch the print head in a controlled location and to guide it into and out of that location in a manner that prevents debris from being transferred to the electrical connector contacts. In at least one embodiment, the latching components are a part of the print head so that the operator can fix a broken latch problem by installing a new print head.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In the illustrative mailing machine and postage meter described in the present application, a print head carriage and print head having a latching system is shown.

Figure 1:
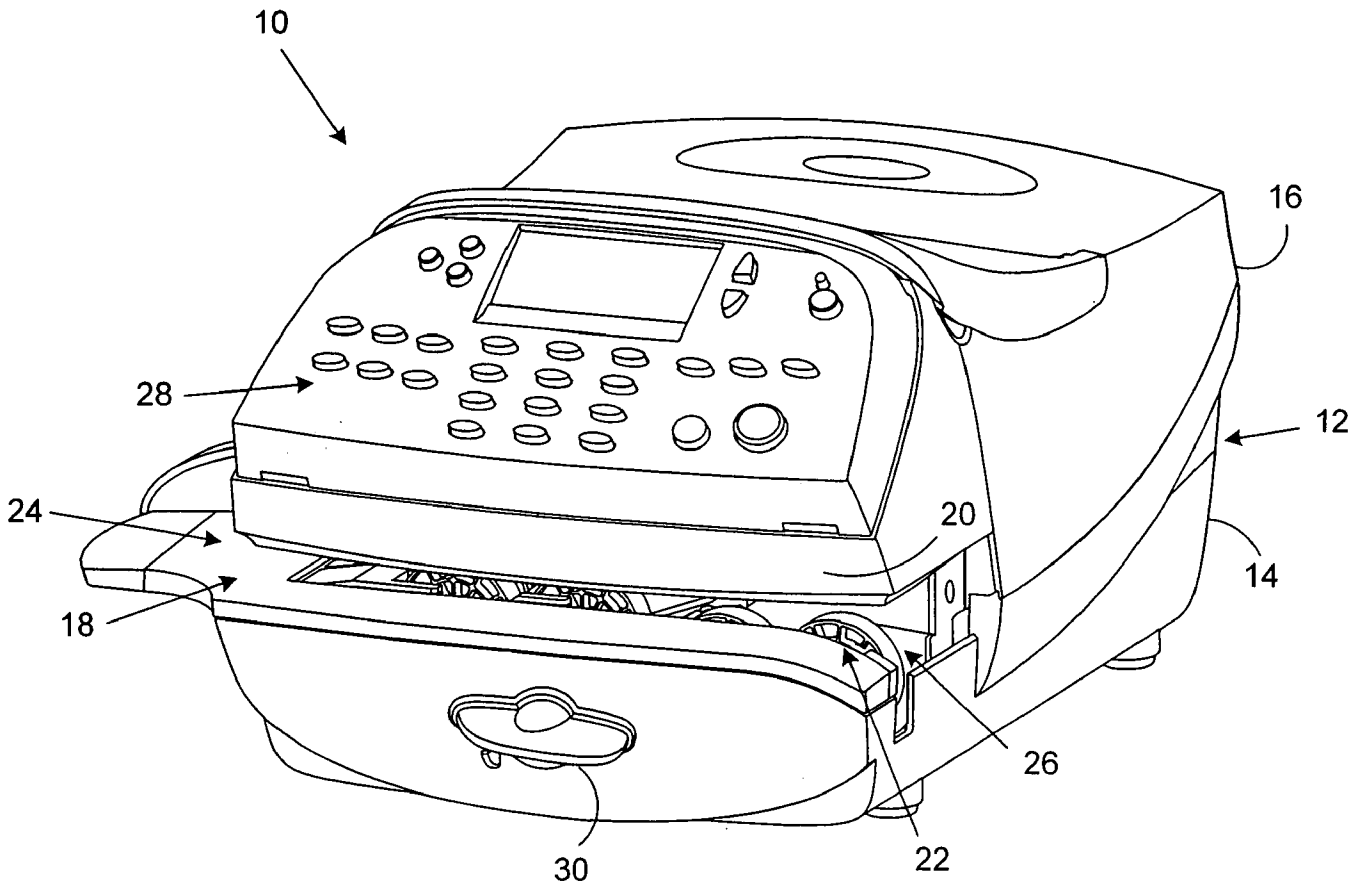
FIG. 1 is an isometric view of a postage meter in accordance with an illustrative embodiment of the application.

Referring now to the drawings, and particularly to FIG. 1, the reference numeral 10 generally indicates a postage meter provided in accordance with the invention.

The postage meter 10 includes a housing 12 formed of a lower case section 14 and an upper case section 16. A slot 18 formed in the front 20 of the housing 12 allows a mail piece (not shown) to be transported through the postage meter 10. The postage meter 10 also includes a transport unit 22 (partially visible through the slot 18) positioned at the slot 18 to transport the mail piece from an infeed side 24 of the slot 18 to an outfeed side 26 of the slot 18. The postage meter 10 further includes a user interface 28 at the front 20 of the housing 12, and a lever 30 positioned below the slot 18 to aid in clearing jams from the transport unit 22.

Figure 2:
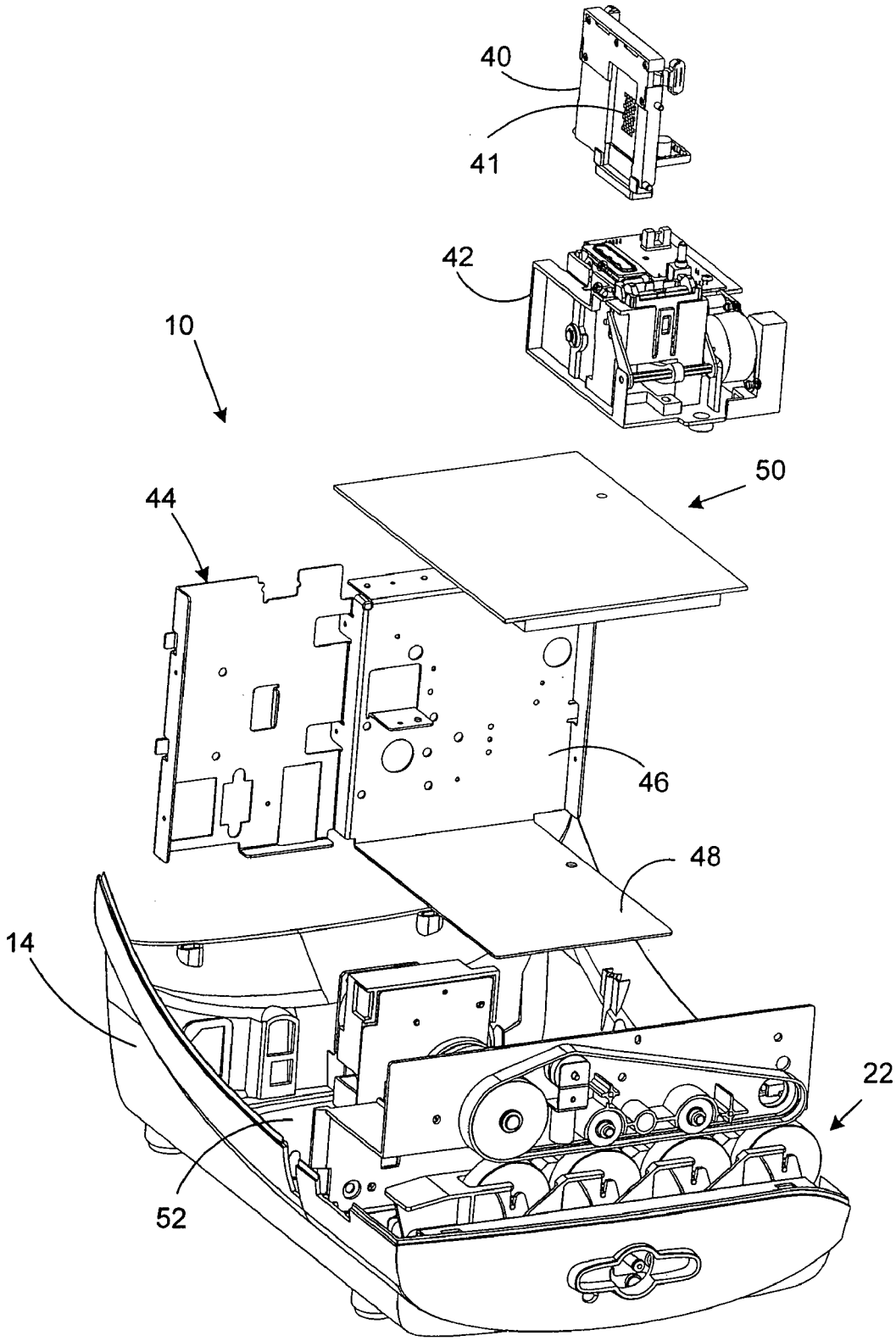
FIG. 2 is a partially exploded view showing some of the internal components of the postage meter of FIG. 1.

FIG. 2 is a partially exploded view showing some of the internal components of the postage meter 10. In addition to the above-mentioned transport unit 22 (which is more clearly visible in FIG. 2), the postage meter 10 includes an ink jet print head 40. In accordance with conventional practices, the transport unit 22 may operate to transport a mail piece (not shown) past the print head 40 so that the print head 40 may print a postage indicia on the mail piece.

The postage meter 10 also includes a waste ink purge unit 42. At appropriate times, the purge unit 42 may come into engagement with the print head 40 to remove excess ink, dried or partially dried ink and/or air bubbles from the print head 40. By a mechanism which is not shown, the print head 40 may be moveable in fore-and-aft directions between a print position adjacent the front of the meter 10 and a purge position that is aft of the print position. When in the print position, the print head 40 may operate to print postage indicia on mail pieces. When in the purge position, the print head 40 may be purged of waste ink by the purge unit 42. Print head 40 includes a connector 41 having electrical contacts.

The postage meter 10 further includes a metal chassis 44. The metal chassis 44 includes a vertical section 46 to which certain components (not shown in FIG. 2) of the postage meter 10 may be mounted. The metal chassis 44 also includes a horizontal metal plate 48 which may be integrally formed with at least part of the vertical section 46 of the metal chassis. The metal plate 48 extends horizontally outwardly from the metal chassis 44 in a forward direction.

Also included in the postage meter 10 is a waste ink tray assembly 50. When the postage meter 10 is in an assembled condition (not shown in FIG. 2), the metal chassis 44 may rest on the bottom 52 of the lower case section 14 of the housing 12, with the waste ink tray assembly 50 supported by and resting on the metal plate 48. When the postage meter 10 is in its assembled condition, the waste ink tray assembly 50 is positioned below the purge unit 42 to receive from the purge unit 42 waste ink removed from the print head 40 by the purge unit 42.

Referring to FIGS. 3–7, an illustrative printing mechanism according to an embodiment of the present application is shown. Many advantages of the present system exist, including, but not limited to reducing cost and avoiding operational problems of the system. Furthermore, such system allows a lower printer height.

Figure 3:
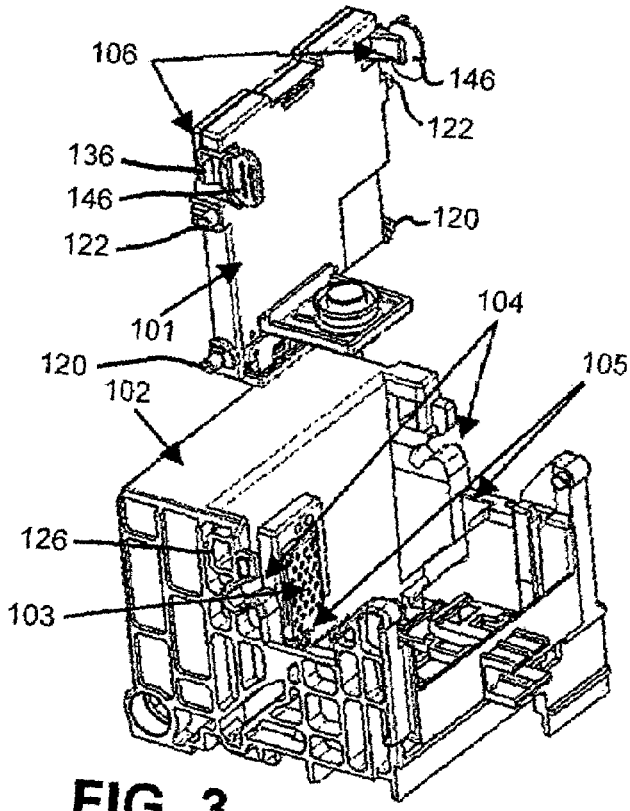
FIG. 3 is an isometric view of a print head carriage and a separate print head according to an illustrative embodiment of the present application.

FIG. 3 shows a print head 101 and print carriage 102 with the print head not installed. The print head carriage 102 includes a connector 103 that includes electrical contacts that are used to engage the electrical connector on the print head 101. The print head electrical connector is shown in FIG. 2 as connector 41. The print head carriage 102 includes upper guide slots 104 and lower guide slots 105 for guiding the print head 101 into the installed position.

The print head 101 includes two sliding latches 106 that each has a latch 136 connected to a flexible spring loaded thumb ear 146. The latches 136 engage the latch sockets 126 molded into the print head carriage 102. The print head 101 includes a set of lower guide pins 120 and upper guide pins 122 that engage the respective guide slots 104, 105 of the print head carriage 102.

Figure 4:
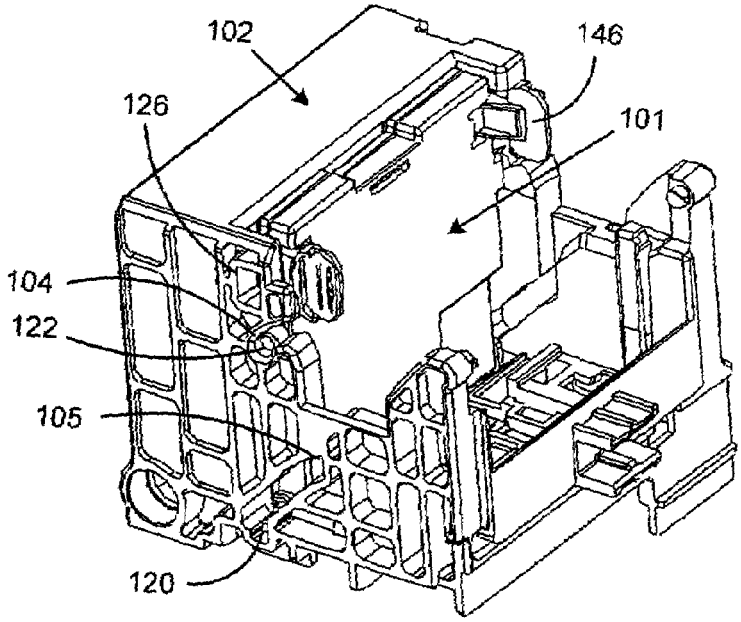
FIG. 4 is an isometric view of a print head carriage having an installed print head according to an illustrative embodiment of the present application.

FIG. 4 shows the print head 101 installed in the print carriage 102. The upper guide pins 122 are installed into the upper guide slots 104 and the lower guide pins 120 are installed into the lower guide slots 105. The print head 101 has compressed a loading spring when inserted into the print head carriage so that when thumb ears 146 are compressed, the latches 136 disengage the latch socket 126 and the spring will urge the print head upward into the guide slots.

Figure 5:
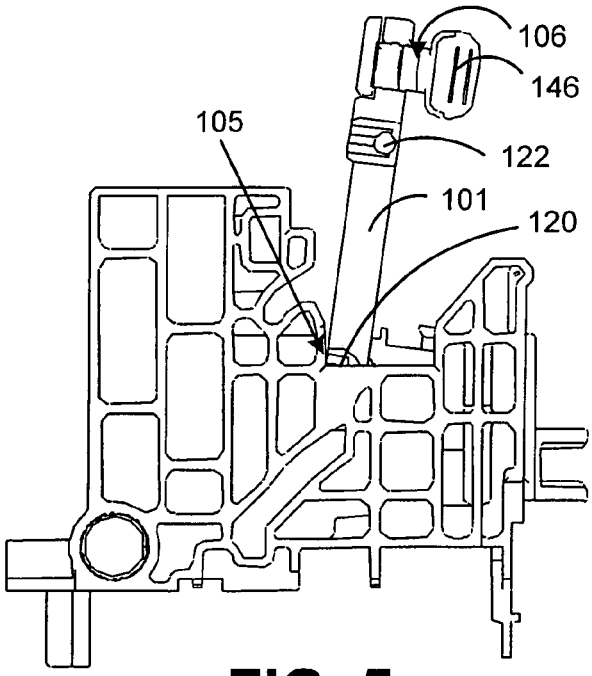
FIG. 5 is a partially exploded view showing the print head carriage and print head during print head installation according to an illustrative embodiment of the present application.

FIG. 5 shows the print head 101 as it is being installed into the print head carriage 102. The lower guide pins 120 on the print head are shown entering the slots lower guide slots 105 in the print head carriage 102. The print head 101 is shown being inserted into the print carriage 102 in a partially installed position. As shown, the lower guide pins 120 keep the lower structure of the print head 101 away from the electrical connector contacts 103 on the print head carriage 102. As the print head travels in the guide pins toward the end of the channel, the print head may then rotate to contact the inside wall of the print carriage.

Figure 6:
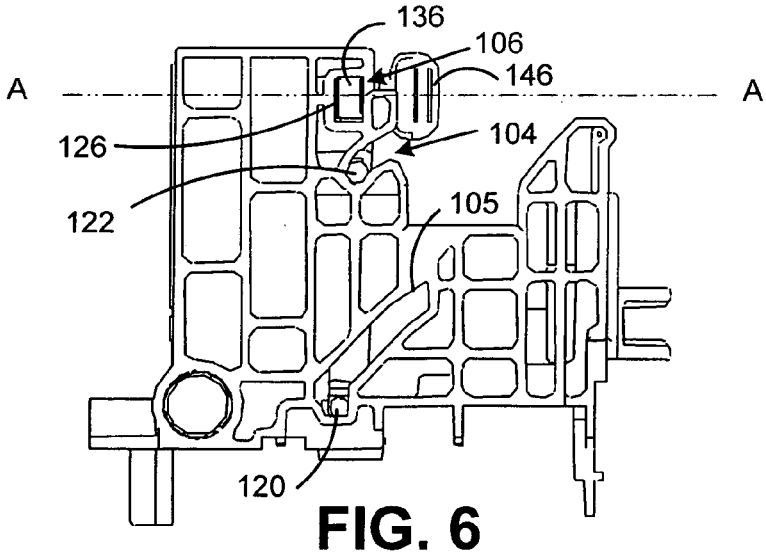
FIG. 6 is a partially exploded view showing the print head carriage and print head during print head installation according to an illustrative embodiment of the present application.

FIG. 6 shows the print head 101 installed in the print carriage 102 and shows the upper guide pins 122 of the print head 101 in the upper guide slots 104 of the print head carriage 102. The right side of the latching features is shown with latch 136 of the print head 101 engaged in latch socket 126 of print carriage 102.

Figure 7:
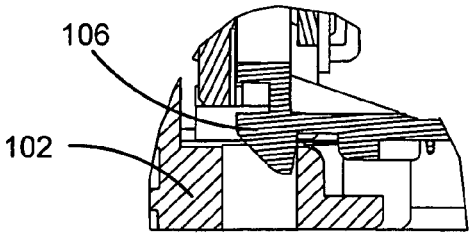
FIG. 7 is a partially cut away view along dotted dashed line A—A in FIG. 6.

In FIG. 7, a partial cutaway of an illustrative printing mechanism along a section A—A of one latch is shown. The section is through the horizontal dashed-dotted line A—A line shown in FIG. 6 and shows a cutaway of sliding latch 106 and the print carriage 102.

Also included, but not shown in the figures is a ramped shape of the top of the latches that urge the print head downward to the vertical datum for the print head in the print carriage. Also included, but not shown in the figures is a single compression spring that is used to move the latches into their respective openings in the print carriage when they are released. Accordingly, in this illustrative embodiment, the system for control and latching of the print head requires only four parts including the two identical latches, a compression spring and a cover to trap them against the body of the print head. Additionally, in this illustrative embodiment, the four parts are a part of the print head assembly rather than a part of the print carriage assembly. In a situation in which the latches are broken, the print head may simply replaced by the operator rather than requiring that a technician replace the print carriage. In an alternative, the four parts are incorporated in the carriage.

The present application describes illustrative embodiments of a printing mechanism. The embodiments are illustrative and not intended to present an exhaustive list of possible configurations. Where alternative elements are described, they are understood to fully describe alternative embodiments without repeating common elements whether or not expressly stated to so relate. Similarly, alternatives described for elements used in more than one embodiment are understood to describe alternative embodiments for each of the described embodiments having that element.

The described embodiments are illustrative and the above description may indicate to those skilled in the art additional ways in which the principles of this invention may be used without departing from the spirit of the invention. Accordingly, the scope of each of the claims is not to be limited by the particular embodiments described.

What is claimed is:

1. A printing mechanism comprising:

a print head having at least one sliding latch and at least one print head electrical contact;

a print head carriage including at least one guide slot for receiving the sliding latch and at least one carriage electrical contact;

the print head having at least one guide pin; and the print head carriage including at least one guide pin slot for receiving the guide pin, wherein, the at least one print head electrical contact is located on a vertical side wall of the print head;

the at least one carriage electrical contact is located on an inside vertical side wall of the carriage, the at least one guide pin slot allows the print head to rotate toward the inside vertical side wall of the carriage after some downward movement, the at least one guide pin slot allows the print head to rotate toward the inside vertical side wall of the carriage after full downward movement in the guide pin slot, and wherein, the at least one sliding latch is a molded spring latch having a finger tab.

2. The printing mechanism according to claim 1, wherein, the at least one sliding latch includes two sliding latches.

3. The printing mechanism according to claim 1, wherein, the at least one guide pin slot and the at least one guide pin prevent the at least on print head electrical contact from contacting the at least one carriage electrical contact during an initial downward movement.

4. The printing mechanism according to claim 1, wherein, the at least one guide pin slot includes a lower guide pin slot and an upper guide pin slot, and the at least one guide pin includes a lower guide pin for engaging the lower guide pin slot and an upper guide pin for engaging the upper guide pin slot, and wherein during installation of the print head into the print head carriage, the lower guide pin is configured to engage the lower guide pin slot before the upper guide pin engages the upper guide pin slot.

5. The printing mechanism according to claim 4, wherein, the lower guide pin slot is longer than the upper guide pin slot.

6. A mailing machine comprising:

a mailing machine housing;

a media transport for moving media into proximity of a printing mechanism;

the printing mechanism including a print head;

the print head having at least one sliding latch and at least one print head electrical contact;

a print head carriage including at least one guide slot for receiving the sliding latch and at least one carriage electrical contact;

the print head having at least one guide pin;

the print head carriage including at least one guide pin slot for receiving the guide pin, and wherein, the at least one print head electrical contact is located on a vertical side wall of the print head; and the at least one carriage electrical contact is located on an inside vertical side wall of the carriage, the at least one guide pin slot allows the print head to rotate toward the inside vertical side wall of the carriage after some downward movement, the at least one guide pin slot allows the print head to rotate toward the inside vertical side wall of the carriage after full downward movement in the guide pin slot, and wherein, the at least one sliding latch is a molded spring latch having a finger tab.

7. The mailing machine according to claim 6, wherein, the at least one sliding latch includes two sliding latches.

8. The mailing machine according to claim 6, wherein, the at least one guide pin slot and the at least one guide pin prevent the at least on print head electrical contact from contacting the at least one carriage electrical contact during an initial downward movement.

9. The mailing machine according to claim 6, wherein, the at least one guide pin slot includes a lower guide pin slot and an upper guide pin slot, and the at least one guide pin includes a lower guide pin for engaging the lower guide pin slot and an upper guide pin for engaging the upper guide pin slot, and wherein during installation of the print head into the print head carriage, the lower guide pin is configured to engage the lower guide pin slot before the upper guide pin engages the upper guide pin slot.

10. The mailing machine according to claim 9, wherein, the lower guide pin slot is longer than the upper guide pin slot.

11. A mailing machine comprising:

a mailing machine housing;

means for transport media into proximity of a printing mechanism;

the printing mechanism including a print head; the print head having at least one sliding latch and at least one print head electrical contact;

means for carrying a print head including at least one guide slot for receiving the sliding latch and at least one carriage electrical contact;

the print head having at least one guide pin;

the means for carrying a print head including at least one guide pin slot for receiving the guide pin; and wherein, the at least one print head electrical contact is located on a vertical side wall of the print head;

the at least one carriage electrical contact is located on an inside vertical side wall of the carriage, the at least one guide pin slot allows the print head to rotate toward the inside vertical side wall of the carriage after some downward movement, the at least one guide pin slot allows the print head to rotate toward the inside vertical side wall of the carriage after full downward movement in the guide pin slot, and wherein, the at least one sliding latch is a molded spring latch having a finger tab.

12. The mailing machine according to claim 11, wherein, the at least one sliding latch includes two sliding latches.

13. The mailing machine according to claim 11, wherein, the at least one guide pin slot and the at least one guide pin prevent the at least on print head electrical contact from contacting the at least one carriage electrical contact during an initial downward movement.

14. The mailing machine according to claim 11, wherein, the at least one guide pin slot includes a lower guide pin slot and an upper guide pin slot, and the at least one guide pin includes a lower guide pin for engaging the lower guide pin slot and an upper guide pin for engaging the upper guide pin slot, and wherein during installation of the print head into the print head carriage, the lower guide pin is configured to engage the lower guide pin slot before the upper guide pin engages the upper guide pin slot.

15. The mailing machine according to claim 14, wherein, the lower guide pin slot is longer than the upper guide pin slot.

* * * * *